US008931859B2

(12) United States Patent
Kozinski et al.

(10) Patent No.: US 8,931,859 B2
(45) Date of Patent: Jan. 13, 2015

(54) CONSUMER APPLIANCE SUCH AS DISHWASHER WITH SOFT OPEN DOOR MECHANISM

(71) Applicant: General Electric Company, Schenectady, NY (US)

(72) Inventors: Kyle A. Kozinski, Louisville, KY (US); Ryan Ellis Leonard, Louisville, KY (US); John Alexander Gardner, Louisville, KY (US); Aaron Matthew McDaniel, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/658,444

(22) Filed: Oct. 23, 2012

(65) Prior Publication Data

US 2013/0063011 A1 Mar. 14, 2013

Related U.S. Application Data

(63) Continuation-in-part of application No. 12/986,445, filed on Jan. 7, 2011, now Pat. No. 8,292,381.

(51) Int. Cl.
*A47B 95/02* (2006.01)
*A47L 15/42* (2006.01)
(Continued)

(52) U.S. Cl.
CPC ..... *A47L 15/4261* (2013.01); *E05F 5/00* (2013.01); *E05F 5/02* (2013.01); *E05Y 2900/304* (2013.01); *E05F 1/1075* (2013.01); *E05Y 2201/626* (2013.01); *E05Y 2800/00* (2013.01)
USPC ..... 312/319.2; 312/328; 49/387

(58) Field of Classification Search
CPC ..... A47L 15/4261; E05F 5/00; E05F 5/02; E05F 1/1075; E05Y 2800/00; E05Y 2201/416; E05Y 2201/626; E05Y 2900/304
USPC ..... 312/319.4, 192, 319.1–319.8, 325–329; 49/386–387; 16/286, 84–85; 188/284, 188/288–289
See application file for complete search history.

(56) References Cited

U.S. PATENT DOCUMENTS 2,921,575 A * 1/1960 Fry ..... 126/191
3,049,114 A * 8/1962 Carnahan et al. ..... 126/191
(Continued)

FOREIGN PATENT DOCUMENTS

EP 2116167 A1 * 11/2009 ..... A47L 15/42
GB 2219623 A 12/1989
WO 2006137039 A2 12/2006

OTHER PUBLICATIONS

Dampers [online]; Datasheet [online]; Aritech Gas Springs; Jun. 28, 2009 [retreived May 18, 2014]. Retreived from the Internet: Wayback Machine <www.aritechgassprings.com/dampers.htm>.*
(Continued)

*Primary Examiner* — Darnell Jayne
*Assistant Examiner* — Ryan A Doyle
(74) *Attorney, Agent, or Firm* — Dority & Manning, P.A.

(57) ABSTRACT

A consumer appliance has a soft open door mechanism. The mechanism may include a damping device with a first end mounted to the cabinet and a second end mounted so as to move with the door. The damping device includes a partial fill damper activatable by an opening movement of the door toward the horizontal position to provide an opposing force to slow the door motion. The damper may be configured so as to initiate the opposing force only when the door has moved at least about 45 degrees from the upright position toward the horizontal position, and/or may be configured so that the damper includes a damping coefficient of about 200 to about 240 lb*s/ft.

25 Claims, 11 Drawing Sheets

(51) Int. Cl.

| | |
|---|---|
| ***E05F 5/00*** | (2006.01) |
| ***E05F 5/02*** | (2006.01) |
| *E05F 1/10* | (2006.01) |

(56) References Cited

U.S. PATENT DOCUMENTS

| | | | | |
|---|---|---|---|---|
| 3,603,658 | A | 9/1971 | Bergeson | |
| 4,281,733 | A * | 8/1981 | Miller et al. | 180/69.21 |
| 4,796,871 | A * | 1/1989 | Bauer et al. | 267/64.11 |
| 4,951,693 | A * | 8/1990 | Archambault | 134/57 DL |
| 4,966,403 | A * | 10/1990 | Nordstrom | 296/76 |
| 5,274,954 | A * | 1/1994 | Quarfordt et al. | 49/386 |
| 5,980,006 | A * | 11/1999 | Wilhelmstatter et al. | 312/319.1 |
| 5,988,933 | A * | 11/1999 | Wilhelmstatter et al. | 403/381 |
| 7,428,953 | B2 * | 9/2008 | Kneip et al. | 188/322.15 |
| 7,640,696 | B2 | 1/2010 | Yingst | |
| 2004/0113531 | A1 * | 6/2004 | Raches | 312/319.2 |
| 2005/0061585 | A1 * | 3/2005 | Yingst | 186/38 |
| 2005/0076938 | A1 * | 4/2005 | Jordan et al. | 134/183 |
| 2006/0005468 | A1 * | 1/2006 | McCullough | 49/387 |
| 2008/0189906 | A1 * | 8/2008 | Resnik et al. | 16/54 |
| 2008/0197652 | A1 | 8/2008 | Stratten | |
| 2008/0272678 | A1 * | 11/2008 | Tynes et al. | 312/319.4 |
| 2009/0072686 | A1 * | 3/2009 | Vooren et al. | 312/319.4 |
| 2010/0051067 | A1 * | 3/2010 | Dalsing | 134/46 |
| 2010/0127606 | A1 * | 5/2010 | Collene et al. | 312/327 |
| 2011/0131886 | A1 * | 6/2011 | Durr | 49/386 |

OTHER PUBLICATIONS

Custom Designs [online]; Datasheet [online]; AVM Industries; Dec. 3, 2009 [retreived May 18, 2014]. Retreived from the Internet: Wayback Machine <www.avmind.com/custom_designs/asp>.*

Gas Springs [online]; Datasheet [online]; AVM Industries; Nov. 1, 2009 [retreived May 18, 2014]. Retreived from the Internet: Wayback Machine <www.avmind.com/Gas_Springs_15.asp>.*

* cited by examiner

CONSUMER APPLIANCE SUCH AS DISHWASHER WITH SOFT OPEN DOOR MECHANISM

RELATED APPLICATIONS

The present application claims benefit under 35 U.S.C. §120 and is a continuation-in-part of U.S. patent application Ser. No. 12/986,445, filed Jan. 7, 2011, to be issued Oct. 23, 2012, as U.S. Pat. No. 8,292,381, which is incorporated by reference herein for all purposes.

FIELD OF THE INVENTION

The present disclosure relates generally to door opening mechanisms for consumer appliances such as dishwashers.

BACKGROUND OF THE INVENTION

Dishwashers of various types have been proposed with a bottom-hinged door. Typically a user pulls on the top of the door to open it. In some dishwashers, the user must manipulate a mechanism, handle, latch, button, etc., of some sort before the door can be opened. In others, the user must simply pull hard enough to overcome a typically spring-loaded mechanism to open the door.

The physics of door opening can thus vary from the start in terms of force required. Doors also vary in weight and center of gravity as well from model to model, and both of these can vary for a particular model depending on whether a detergent container or the like housed in the door is full or empty. Counterbalancing springs are often included to oppose door opening force or to assist in holding a door closed or reclosing it. Those springs may be more active around the closed position (with the door vertical) than around the opened position (with the door horizontal).

Some doors may move somewhat freely or even accelerate as they approach the fully opened (horizontal) position, especially if the doors have compartments loaded with liquids. The pivoting center of gravity of the door has a weight that applies a torque when it moves out from over the hinge at the bottom of the door. Rapid movement toward the end of travel can lead to hard bounces off stops or even damage for some models with less than optimal opening parameters and/or due to user inattention.

Accordingly, other designs for door mechanisms for consumer appliances such as dishwashers, including those addressing one or more drawbacks of conventional devices and dishwashers would be welcome.

BRIEF DESCRIPTION OF THE INVENTION

Aspects and advantages of the invention will be set forth in part in the following description, or may be obvious from the description, or may be learned through practice of the invention.

According to certain aspects of the present disclosure, a consumer appliance with a soft open door mechanism includes, for example, a cabinet having top and a bottom and defining an opening along a front side and a door having a top and a bottom and attached by a hinge to the front side of the cabinet. The hinge is located at a bottom of the door so that the door is movable between an upright position closing the opening and a substantially horizontal position opening the opening, the upright position and the horizontal position being substantially 90 degrees apart. A tension device is mounted in the cabinet so as to oppose movement of the door toward the horizontal position. A damping device has a first end mounted to the cabinet and a second end mounted so as to move with the door. The damping device includes a partial fill damper activatable by an opening movement of the door toward the horizontal position to provide an opposing force to slow the door motion. The damper is configured so as to initiate the opposing force only when the door has moved at least about 45 degrees from the upright position toward the horizontal position. Various options and modifications are possible.

According to certain other aspects of the disclosure, a consumer appliance with a soft open door mechanism includes, for example, a cabinet having top and a bottom and defining an opening along a front side and a door having a top and a bottom and attached by a hinge to the front side of the cabinet. The hinge is at a bottom of the door so that the door is movable between an upright position closing the opening and a substantially horizontal position opening the opening, the upright position and the horizontal position being substantially 90 degrees apart. A tension device is mounted in the cabinet so as to oppose movement of the door toward the horizontal position. A damping device has a first end mounted to the cabinet and a second end mounted so as to move with the door. The damping device including a partial fill damper activatable by an opening movement of the door toward the horizontal position to provide an opposing force to slow the door motion. The damper is configured so as to initiate the opposing force only when the door has moved substantially from the upright position toward the horizontal position. The damper is also configured with a damping coefficient of about 200 to about 240 lb*s/ft. Various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
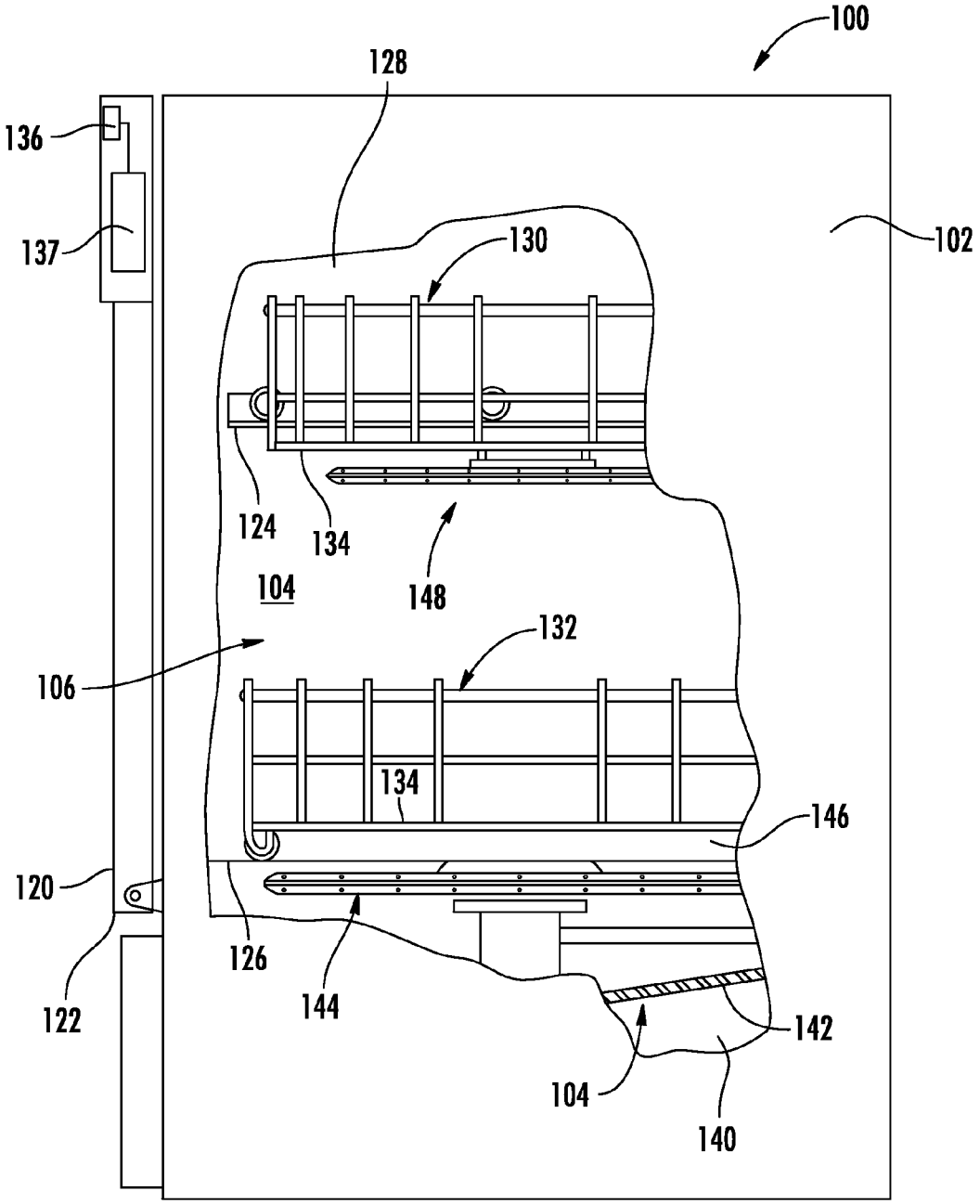
FIG. 1 provides a side partial cut-away view of an exemplary dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As discussed in greater detail below, embodiments of the present disclosure relate to soft open door mechanism for consumer appliances such as dishwashers. FIG. 1 depicts an exemplary domestic dishwasher 100 that may be configured in accordance with aspects of the disclosure. For the particular embodiment of FIG. 1, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles.

Figure 2:
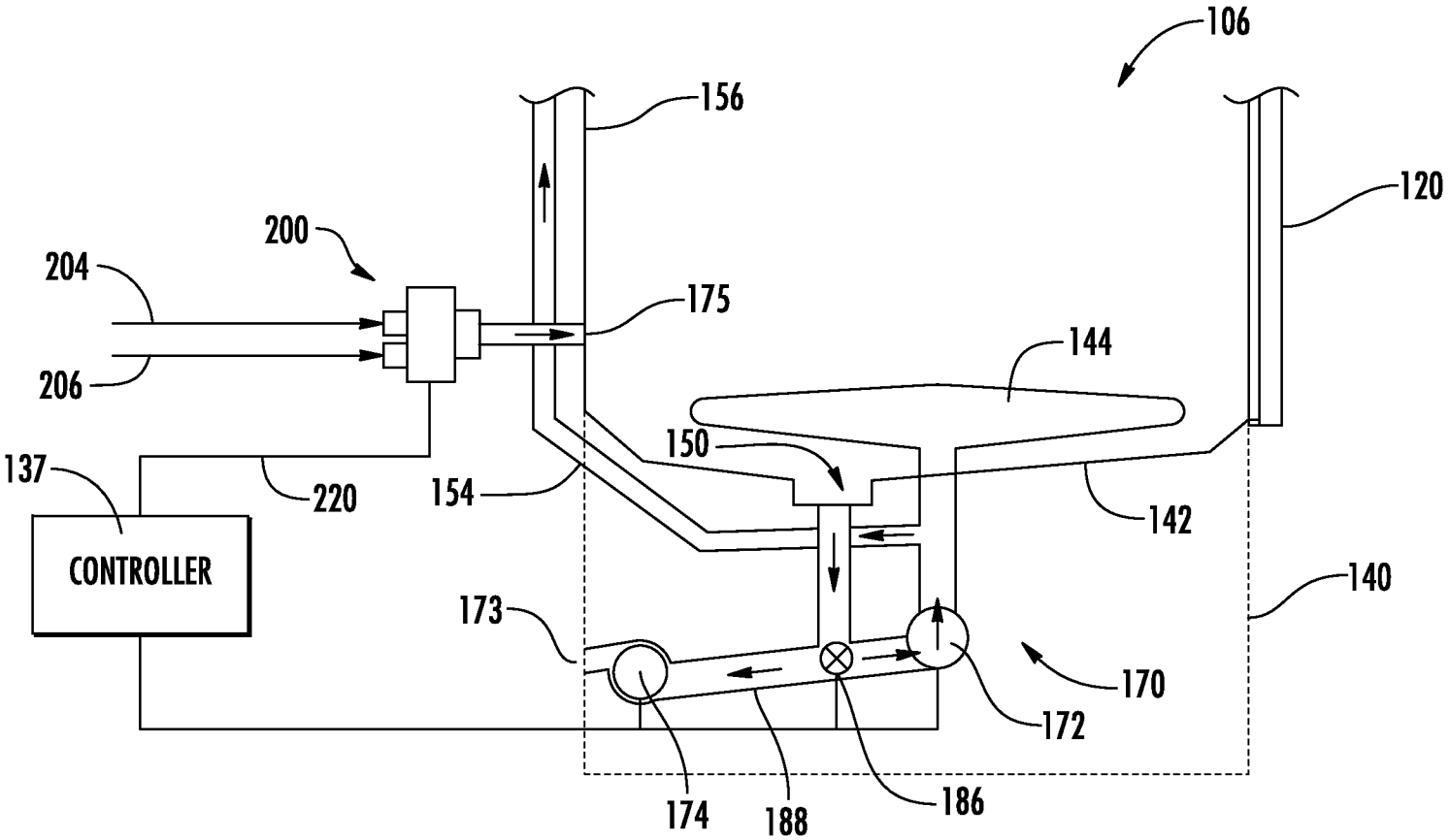
FIG. 2 is a schematic view of one possible fluid system the dishwasher of FIG. 1.

FIG. 2 schematically illustrates an embodiment of a fluid circulation assembly 170 configured below the wash chamber 106. Although one embodiment of a fluid circulation assembly that is operable to perform in accordance with aspects of the disclosure is shown, it is contemplated that other fluid circulation assembly configurations may similarly be utilized without departing from the spirit and scope of the invention. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 of wash chamber 106, and upward along the back wall 156 for feeding wash liquid to the mid-level spray arm assembly 148 (FIG. 1) and the upper spray arm assembly. This configuration also applies to a drawer-type of dishwasher, as mentioned above.

As wash liquid is pumped through the lower spray arm assembly 144, and further delivered to the mid-level spray arm assembly 148 and the upper spray arm assembly (not shown), washing sprays are generated in the wash chamber 106, and wash liquid collects in the sump 150. The sump 150 may include a cover to prevent larger objects from entering the sump 150, such as a piece of silverware or another dishwasher item that is dropped beneath lower rack 132. A coarse filter and a fine filter (not shown) may be located adjacent the sump 150 to filter wash liquid for sediment and particles of predetermined sizes before flowing into the sump 150. Furthermore, a turbidity sensor may be coupled to the sump 150 and used to sense a level of sediment in the sump 150 and to initiate a sump purge cycle where the contents or a fractional volume of the contents of the sump 150 are discharged when a turbidity level in the sump 150 approaches a predetermined threshold. The sump 150 is filled with water through an inlet port 175 which outlets into wash chamber 106, as described in greater detail below.

As shown, a drain valve 186 is established in flow communication with the sump 150 and opens or closes flow communication between the sump 150 and a drain pump inlet 188. The drain pump assembly 174 is in flow communication with the drain pump inlet 188 and may include an electric motor for pumping fluid at the inlet 188 to an external drain system via drain 173. In one embodiment, when the drain pump is energized, a negative pressure is created in the drain pump inlet 188 and the drain valve 186 is opened, allowing fluid in the sump 150 to flow into the fluid pump inlet 188 and be discharged from fluid circulation assembly 170 via the external drain 173. Alternatively, pump assemblies 172 and 174 may be connected directly to the side or the bottom of sump 150, and the pump assemblies may each include their own valving replacing drain valve 186. Other fluid circulation systems are possible as well, drawings fluid from sump 150 and providing as desired within wash chamber 106 or draining out of washing machine 100.

Referring to FIG. 2, a water supply 200 may be configured with the inlet port 175 for supplying wash liquid to the wash chamber 106. The water supply 200 may provide hot water only, cold water only, or either selectively as desired. As depicted, water supply 200 has a hot water inlet 204 that receives hot water from an external source, such as a hot water heater and a cold water input 206 that receives cold water from an external source. It should be understood that the term "water supply" is used herein to encompass any manner or combination of valves, lines or tubing, housing, and the like, and may simply comprise a conventional hot or cold water connection.

Figure 3:
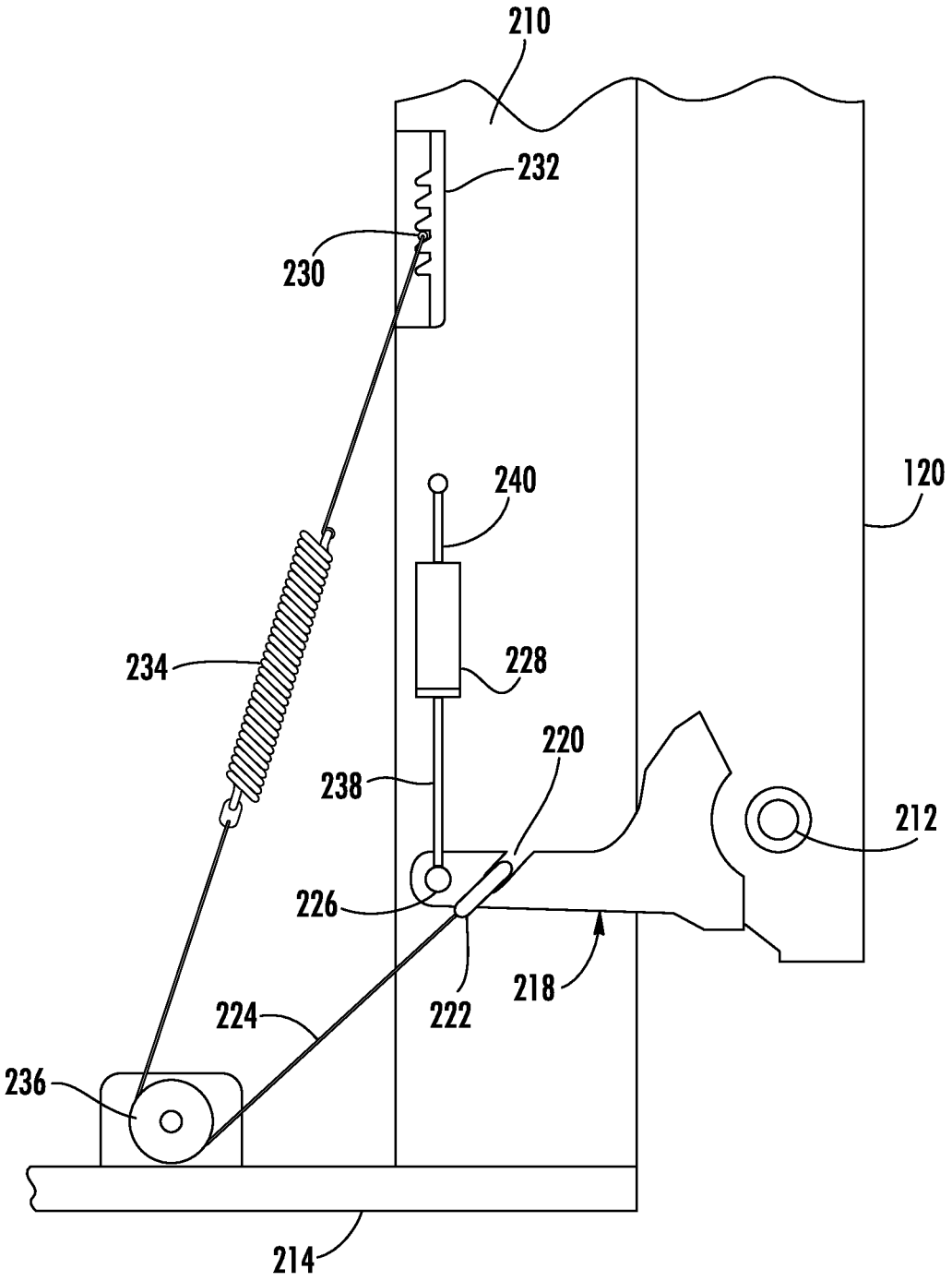
FIG. 3 provides a schematic side view of one possible dishwasher door opening mechanism in a closed position according to certain aspects of the invention.
Figure 4:
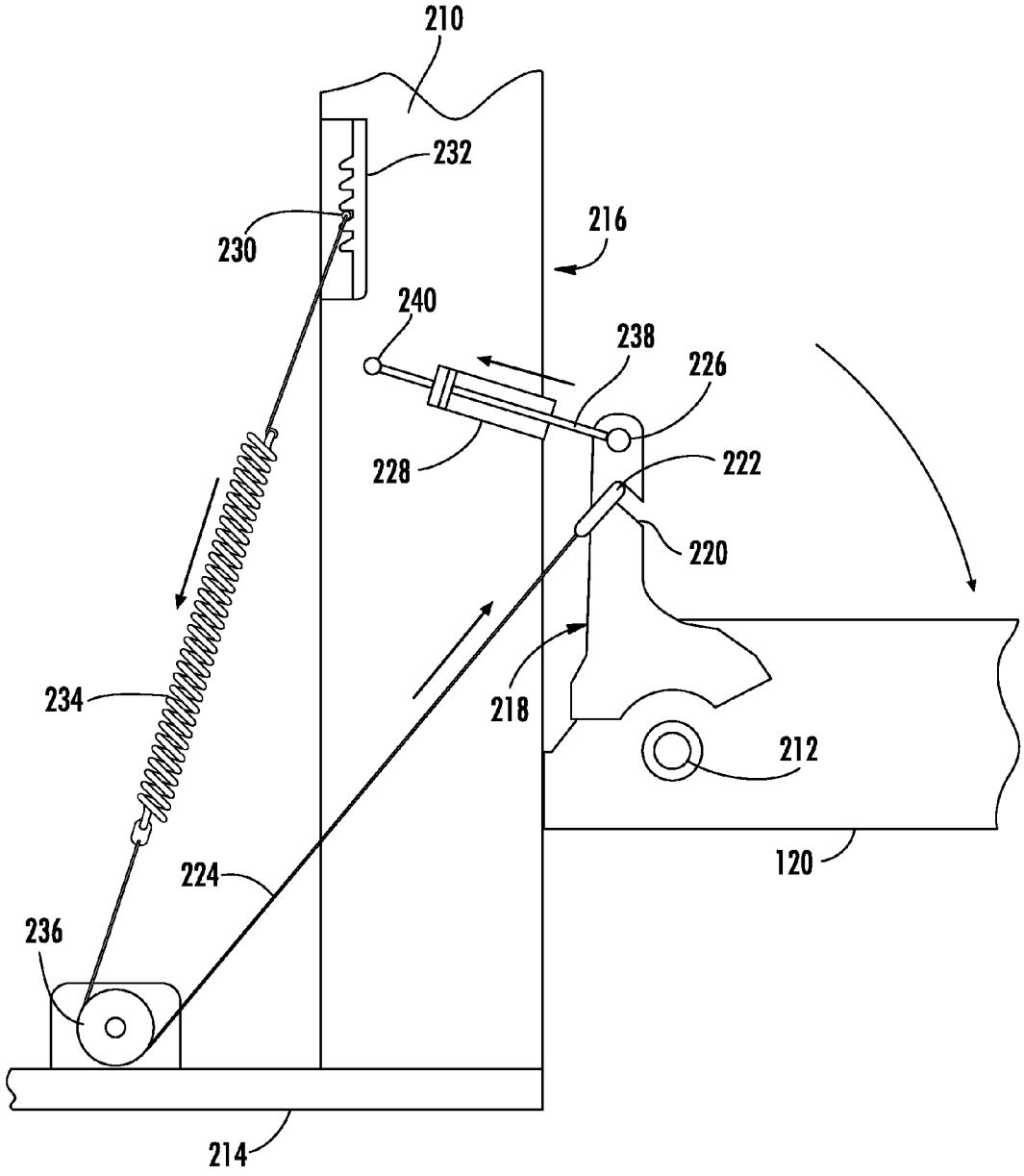
FIG. 4 provides a schematic side view of the mechanism of FIG. 3 in an opened position.

FIGS. 3 and 4 show one example of a door opening mechanism for a consumer appliance such as a dishwasher according to certain aspects of the present disclosure. It should be understood that the mechanisms disclosed herein can be used on one or both sides of the appliance door, if desired, although only one side is shown for clarity. Further, although the present disclosure is shown for convenience in connection with a typical dishwasher configuration, the mechanisms here have applicability to various consumer appliances.

As shown, door 120 is attached to a side member 210 of cabinet 102 (see FIG. 1 for overall view) via a hinge 212 also attached to the cabinet near the bottom of the door. Base member 214 of cabinet 102 extends along a bottom portion of the cabinet. Door 120 is pivotable between a substantially upright, closed position as shown in FIG. 3 and a substantially horizontal open position as shown in FIG. 4. When in the position of FIG. 3, door 120 closes an opening 216 in the front of cabinet 102 as is conventional.

Attached to door 120 near hinge 212 is an arm 218 which moves with the door as it is opened and closed. Arm 218 has a slot 220 for receiving an end 222 of a line 224. Arm 218 also has a hole 226 or other structure for connection to a damper 228.

Line 224 has a second end 230 attached to an adjustable mounting bracket 232 with multiple mounting locations for tensioning the line as desired. Line 224 has at least one tension spring 234 along its length. A roller 236 is attached to a part of cabinet 102 such as base member 214 spaced from door 120.

Damper 228 has a first end 238 attached to arm 218 and a second end 240 attached to a portion of cabinet 102 such as side member 210. Damper 228 may be a conventional pneumatic or hydraulic damper mechanism.

As shown in FIG. 4, when door 120 is pivoted downward, arm 218 correspondingly pivots. Movement of arm 218 causes line 224 to be pulled, thereby stretching and lengthening tension spring 234 and causing a central part of the line to rotate roller 236. Simultaneously, arm 218 compresses damper 228.

If desired, damper 228 may be a partial fill damper, which has less than a 100% fill with a hydraulic fluid such as oil. If so, damper 228 may be activated (i.e., manipulated) without the damping function being active until an amount of motion occurs and the piston within damper 228 begins to contact and compress the hydraulic fluid. For example, if damper 228 were a 10/90 partial fill damper with 10% hydraulic fluid, the damper would not provide substantial damping force until compression (or extension) had reached 90% of the range of motion. Such a damper particularly provides a soft open function at the nearly horizontal stop area (i.e., a "soft open stop"). Accordingly, use of a partial-fill damper, moved continuously whenever door 120 moves but only active at an end portion of the motion toward the horizontal position of FIG. 4, provides a useful soft open stop that can avoid hard bounces at the end of travel as mentioned above. The percentage of fluid in damper 228 diameter of the piston, etc., can be selected in view of the parameters of the door 120 and other components, as desired for a particular application.

It should be understood that modifications are possible. For example, damper 228 could be mounted with second end 240 below arm 218, thereby requiring use of a damper than can operate in extension rather than compression. Also, tension spring 234 could be replaced with a compression spring attached differently as well to push rather than pull arm 218 toward the position of FIG. 3.

Figure 5:
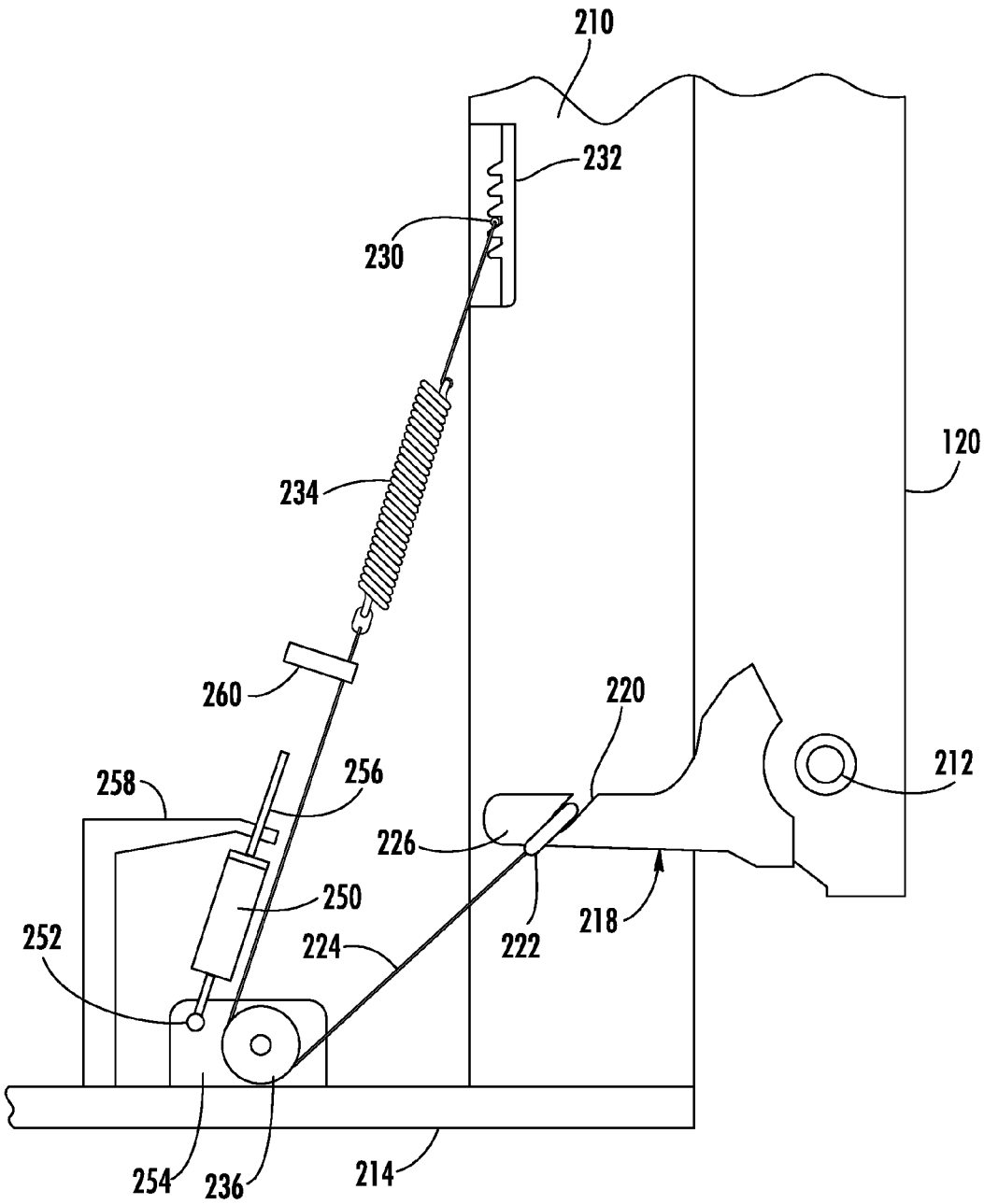
FIG. 5 provides a schematic side view of another possible dishwasher door opening mechanism in a closed position according to certain aspects of the invention.
Figure 6:
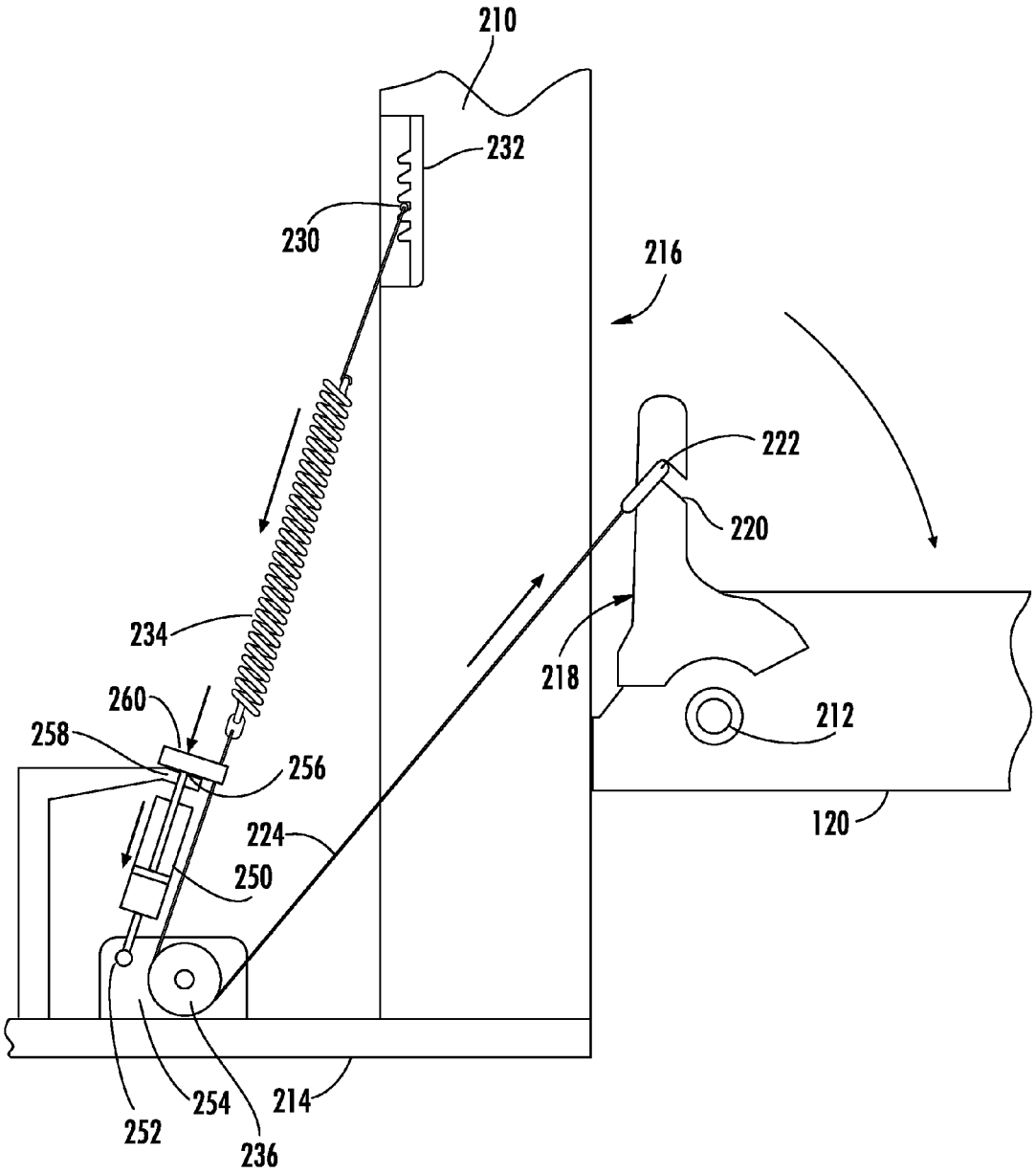
FIG. 6 provides a schematic side view of the mechanism of FIG. 5 in an opened position.

FIGS. 5 and 6 show another example of a soft open door mechanism according to certain other aspects of the invention. Like or similar parts to the example of FIGS. 3 and 4 have like or similar reference numerals hereafter and therefore all need not be discussed again.

The embodiment of FIGS. 5 and 6 includes line 224 mounted to arm 218 and mounting bracket 232 with roller 236 and tension spring 234 in between, as above. Damper 250 has a first end 252 mounted to a portion of cabinet such as roller bracket 254 and a second end 256 held slidably in place by another bracket 258 or other structure within cabinet 102. A stop member 260 extends from line 224 so that when line is pulled damper 250 is compressed.

As illustrated, damper 250 is not a partial fill damper, so the damper is active as soon as end 256 is contacted by stop. In other words, it takes a certain amount of opening of door 120 to move stop 120 down far enough to contact second end 256, at which point damper 250 is active and provides a force to slow the door. Using a conventional damper in this way allows end of 230 of line 224 to be mounted at different locations in bracket 232 for fine tuning, with corresponding changes possible in the location of stop 260 on the line, which can be fixed via a set-screw, for example. Alternatively, stop 260 could be permanently fixed in place and the length of damper 250 (end 256 for example) could be adjustable if such fine tuning feature were desired. Also, damper 250 could be mounted for example to side member 210 near bracket 232 instead of to bracket 254, and could therefore operate in extension rather than compression, if desired.

As another alternative, a partial fill damper could be substituted, as mentioned above. In such case, second end 256 could be fixedly attached to line, for example by attachment to stop 260 or other structure at such location.

Figure 7:
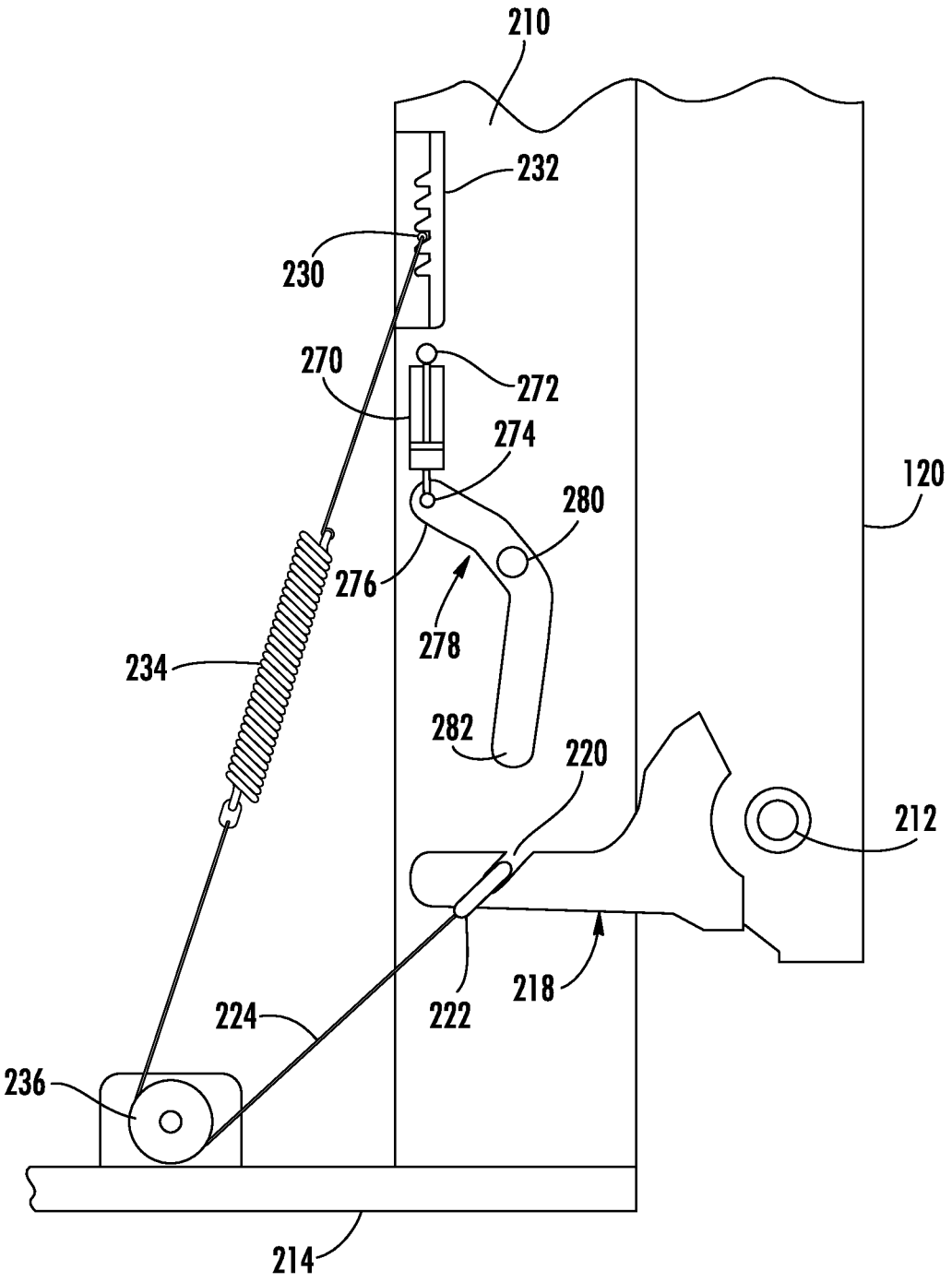
FIG. 7 provides a schematic side view of yet another possible dishwasher door opening mechanism in a closed position according to certain aspects of the invention.
Figure 8:
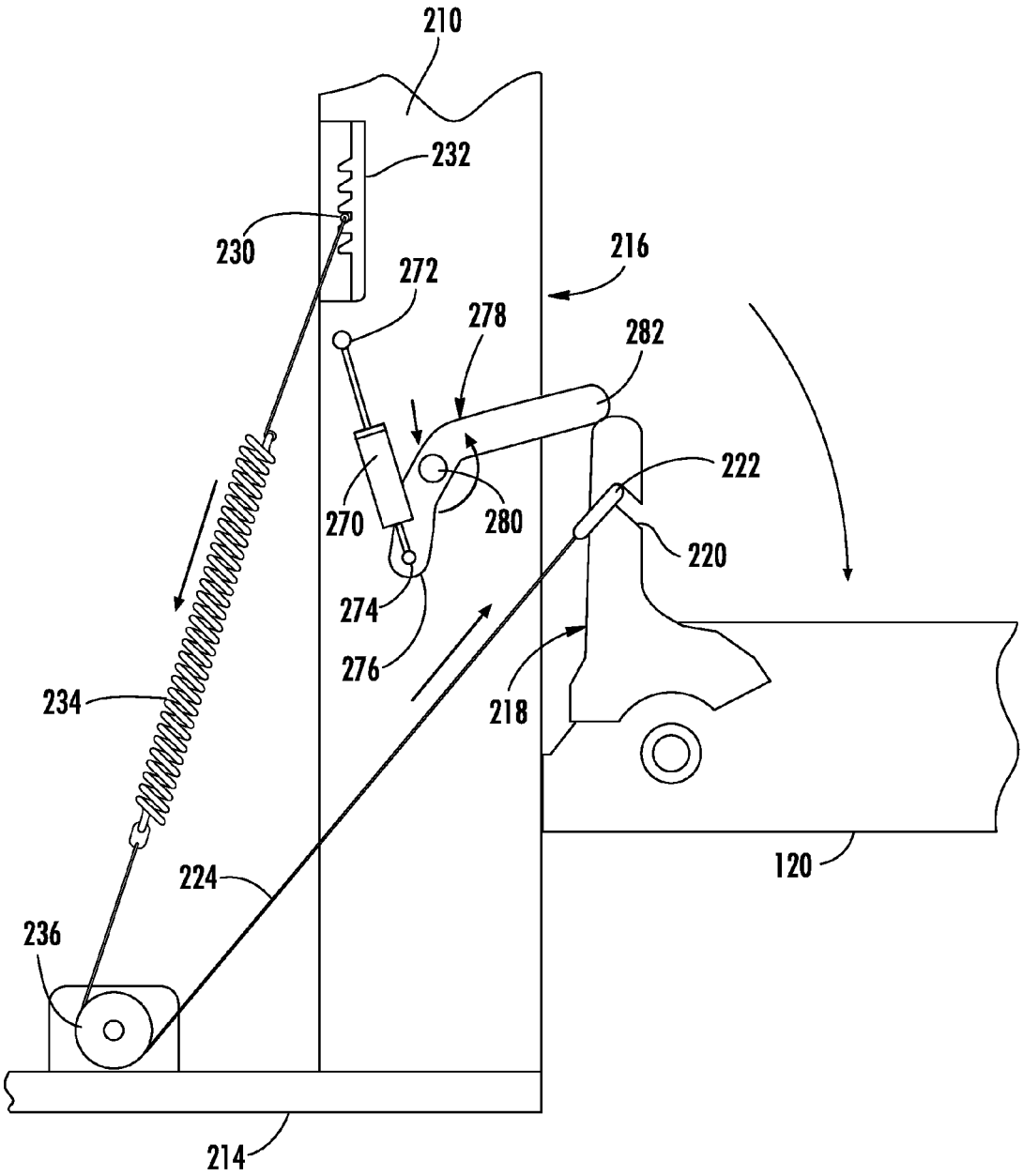
FIG. 8 provides a schematic side view of the mechanism of FIG. 7 in an opened position.

A third example is shown in FIGS. 7 and 8. Again, door 120 is movable about hinge 212 thereby moving arm 218. Line 224 and its components are as shown in FIG. 3 and function similarly. However, damper 270 is mounted at one end 272 to the cabinet such as side member 210 and at the other end 274 to a first end 276 of a trigger arm 278. Trigger arm 278 is mounted at a pivot point 280 to side member 210 and has a second end 282 extending toward arm 218. Trigger arm 278 can be urged toward the position of FIG. 7 (clockwise as shown) via a coil spring (not shown) mounted about pivot point.

A shown in FIG. 7, when door 120 starts to move, arm 218 is not contacting second end 282 of trigger arm 278. Eventually as door 120 is moved further, arm 218 rises to contact second end 282 (a flange, not shown, may be provided on either arm or both to transfer the contact). Further pivoting motion of door 120 toward the horizontal position of FIG. 8 actuates damper 270. The spacing between arm 218 and arm 278 in the door closed position allows use of a conventional (non-partial fill) damper in this embodiment, if desired. That is, damper 270 in such orientation becomes active to oppose motion of the door as soon as the arms are in contact, which is toward the end of travel to the horizontal door position. Again, a soft open stop is achieved in this way. If desired, however, a partial fill damper could be used in this embodiment as well for further fine tuning, possibly with arms 218 and 278 in permanent contact. As above, damper 270 could also be mounted with first end 272 below first end 276 of trigger arm 278 and could thus operate in compression rather than in extension.

Figure 9:
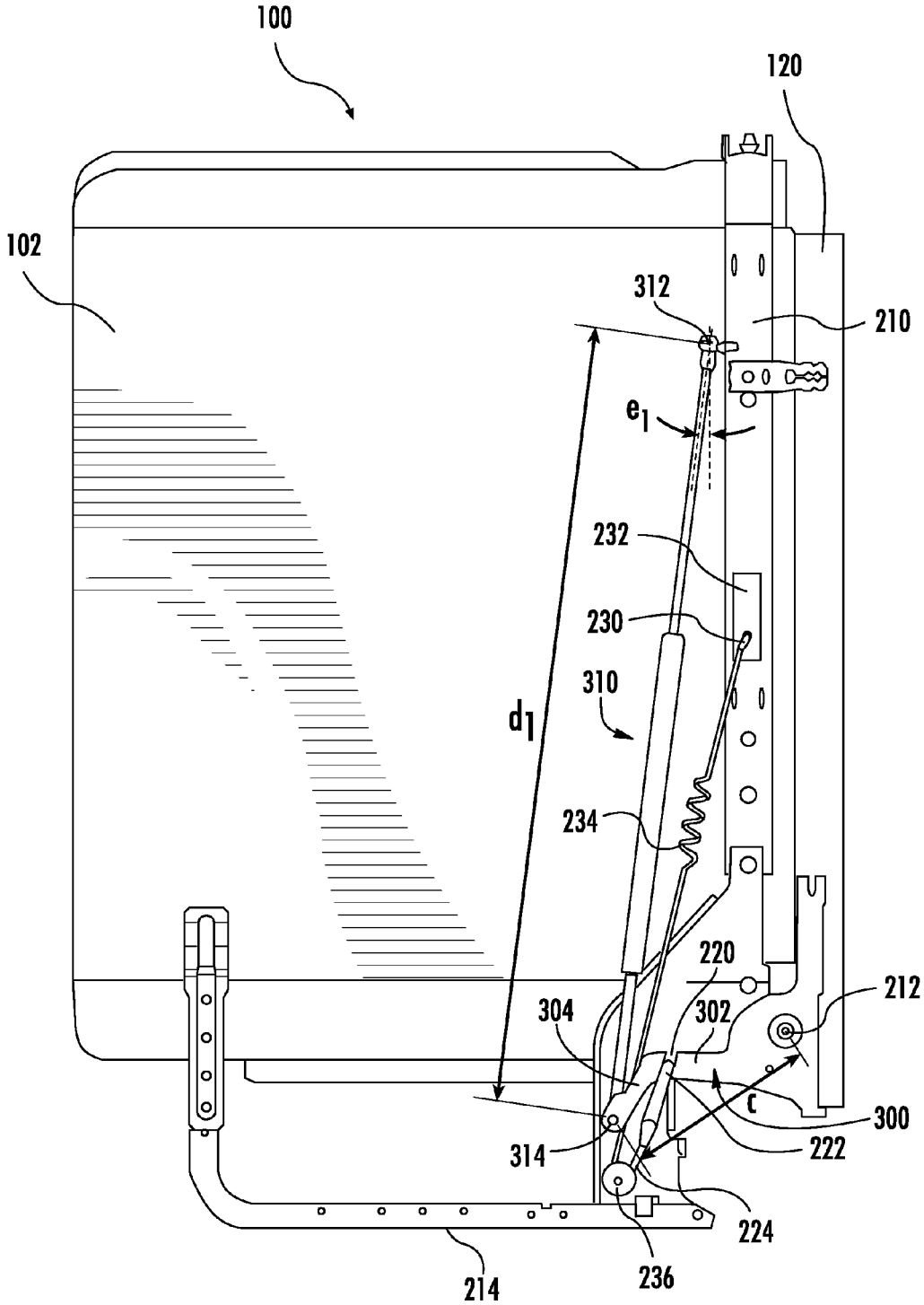
FIG. 9 provides a schematic side view of another possible dishwasher door opening mechanism in a closed position according to certain aspects of the invention.
Figure 10:
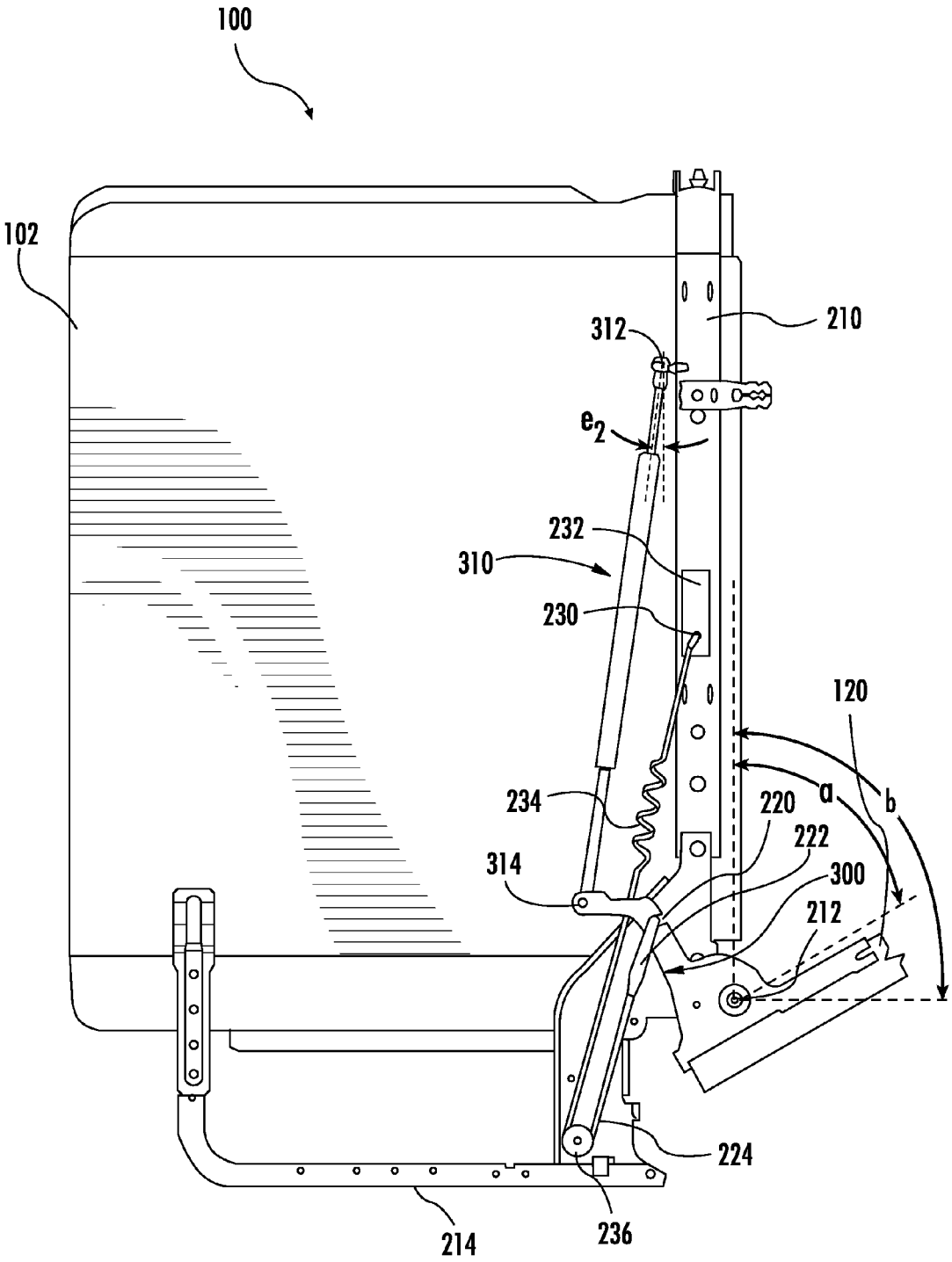
FIG. 10 provides a schematic side view of the mechanism of FIG. 9 in a position in which damping begins.
Figure 11:
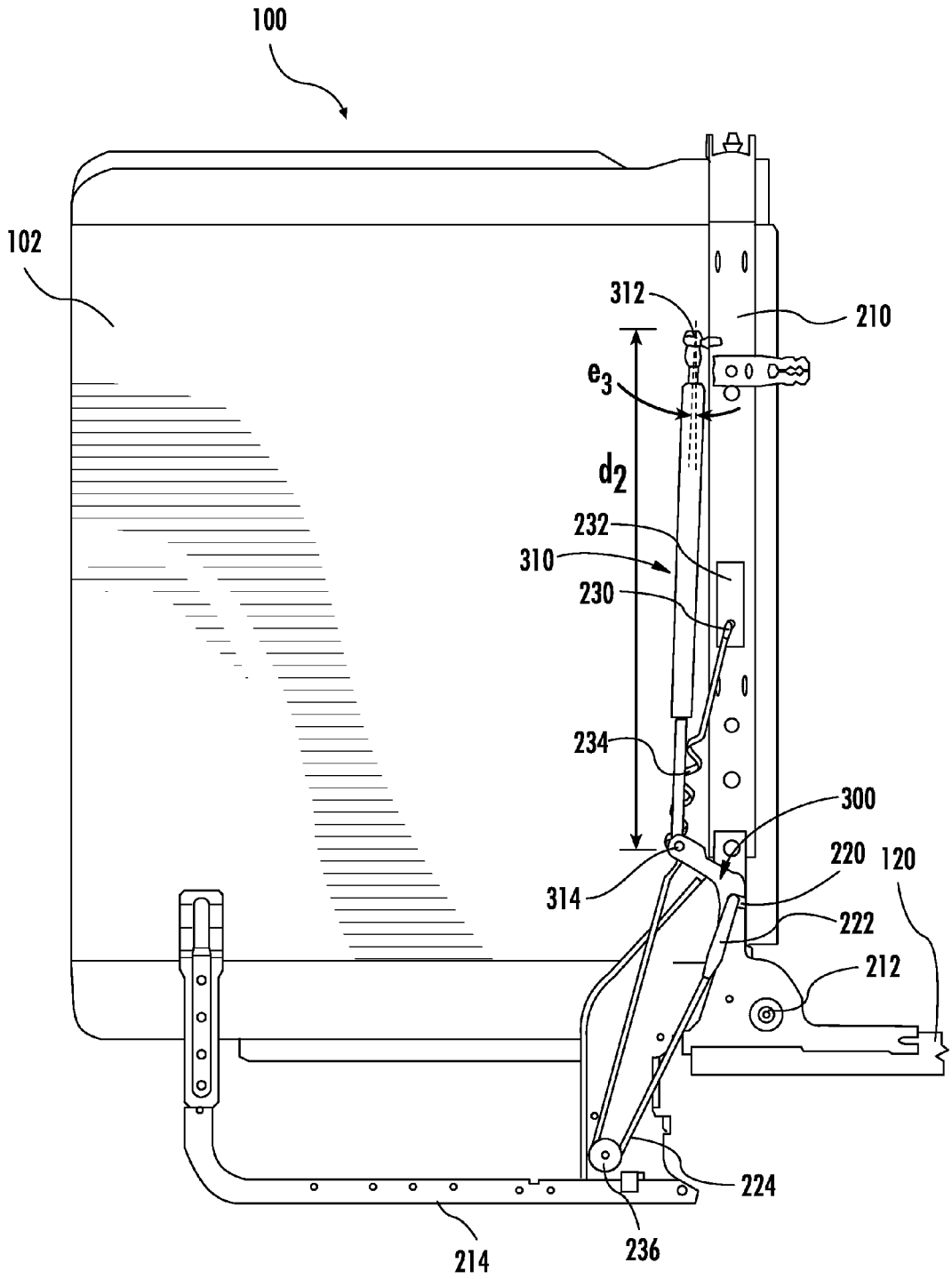
FIG. 11 provides a schematic side view of the mechanism of FIG. 9 in an opened position.

FIGS. 9-11 show another embodiment of a soft open door mechanism according to certain other aspects of the disclosure. As above, like or similar parts to the previous examples have like or similar reference numerals and therefore all need not be discussed again.

In the embodiment of FIGS. 9-11, washing machine 100 includes a cabinet 102 and a door 120 attached to the cabinet by a hinge 212. Door 120 is moveable from a substantially vertical, closed orientation as shown in FIG. 9 to a substantially horizontal, opened position as shown in FIG. 11 via pivoting around hinge 212, as above.

Attached to door 120 near hinge 212 is an arm 300 which moves with the door as it is opened and closed. Arm 300 may have a first portion 302 defining a slot 220 and a second portion 304 that may extend distally past the slot, and may extend angled relative to the first portion. Slot 220 is located for receiving a first end 222 of tension device such as a line 224. A second end 230 of line 224 is attached to an adjustable mounting bracket 232 that can be located on side member 210, as shown and as described above. Mounting bracket 232 could instead be located at a bottom rear portion of the cabinet 102, such as an upright portion of base member 214. Line 224 has at least one tension spring 234 along its length. A roller 236 is attached to a part of cabinet 102 such as base member 214 spaced from door 120. Line 224 and spring 234 are placed in tension when door 120 is opened, thereby providing force (generally equal to a spring coefficient times change in distance of extension of the spring) and resulting torque to the door in a counterclockwise direction (as shown) urging the door toward the closed position of FIG. 9. The location of roller 236 dictates the direction from which line 224 pulls on first portion 302 of arm 300 when door 120 is moved from the closed position of FIG. 9 toward the opened position of FIG. 11.

A damping device 310 is provided to oppose movement of door 120 toward the open position. Damping device 310 has a first end 312 mounted to cabinet 102 such as at side member 210 and a second end 314 mounted so as to move with door 120. Second end 314 may be mounted to second portion 304 of arm 300, as shown. Damping device 310 may be a partial fill damper activatable by opening movement of the door 120 toward the opened horizontal position of FIG. 11. Damping device 310 may provide an opposing force (generally equal to a coefficient of damping times axial velocity of the damper piston movement) and resulting torque to slow motion of door 120 as it approaches the horizontal position, thereby beneficially providing a soft open feature for a user.

Damping device 310 may be configured so as to initiate the opposing force only when door 120 has moved at least about 45 degrees from the upright position toward the horizontal position. If desired, damping device 310 may be configured so as to initiate the opposing force only when the door has moved at least about 60 degrees from the upright position toward the horizontal position. Angle a in FIG. 10 shows the orientation at which such damping force begins, within the full travel defined by angle b.

Arm 300 may be configured so that damping device second end 314 is mounted to the arm at a distance c (see FIG. 10) from the center of hinge 212. As shown herein distance c is about 6 inches, but this may vary depending on the damping device selected. Damping device 310 may have a fully extended length $d_1$ of about 24 inches (see FIG. 9) and a fully compressed length $d_2$ of about 16 inches (see FIG. 11). Damping device 310 may have be a partial fill damper with no more than about 35% fill of fluid such as oil providing opposing force for no more than about 35% of travel. If desired, no more than about 28% fluid fill providing a force at no more than 28% of travel can be employed. A suitable damping coefficient for the damper may be in the range of 221.533 lb*s/ft with a tolerance of +/−22.154, and a suitable fluid viscosity for the fluid within the damper may be provided by an oil having a specific gravity of about 0.98.

The angle between a centerline of damping device 310 and a vertical line can vary between $e_1$ as shown in FIG. 9, $e_2$ in FIG. 10, and $e_3$ in FIG. 11. Angle e3 is substantially zero, and may be a small number such as 2 degrees. Using the dimensions above, the maximum angle of the centerline of damping device 310 from vertical is about 10 degrees at about 38% opening (a position between that of FIGS. 9 and 10). Accordingly, both $e_1$ and $e_2$ are less than about 10 degrees.

Selection of the lengths and configurations of arm portions 302 and 304, as well as the length, fill amount, coefficient of damping, and active length of damping device 310, can provide a stroke that is controlled to as to provide a smooth, soft opening at a desired portion of the opening of door 120. In particular, use of a relatively lengthy, partial fill damping device 310 with several inches of travel during compression (here about 8 inches), only a third of which or less is active, at about 6 inches from hinge 212, allows for a smooth application of force at a desired orientation, whereas use of a shorter damping device instead might apply force in a more undesirably abrupt manner. Also, by using a relatively lengthy damping device 310 and an arm 300 of about 6 inches, much of the motion applied to the damping device is axial with reference to the damping device throughout the motion, again providing a smooth application of force.

Damping device 310 may be a bypass damper having openings in a damper piston and/or bypass slots in the housing, to allow fluid flow past the damper piston at a desired rate in view of a desired force. In the present device, a suitable force may be applied by a partial fill damper that meets the following: when a 15 pound load is applied axially to the damper in a fully extended position, the damper reaches a fully compressed position in about 10 seconds. A suitable damping coefficient of such a damper may be in about 220 lb*s/ft, but may also be about 200 to about 240 lb*s/ft, although wider ranges could be employed depending on application. A suitable fluid viscosity for the fluid within the damper may be provided by an oil having a specific gravity of about 0.98 at 70 F.

Such function provides a beneficial soft opening feature in connection with a 6 inch arm 300, regardless of the dimensions and parameters of damping device 310, tension device, etc., in some aspects of the invention. It should be understood that some modification of the above parameters is possible with regard to damper length, active damper length, arm length, etc. Suitable dampers can be obtained from various suppliers, such as Suspa, Inc. of Grand Rapids, Mich. or AVM Industries of Marion, S.C.

If desired, parameters of damping device 310 can be modified in view of the configuration or weight of door 120 to achieve smooth damping starting at about 45 or 60 degrees from open, or with a given desired force. Typical doors weigh in the range of about 18-20 pounds, with a center of gravity approximately 12 inches from hinge 212. However, optional custom door panels may add 5-20 pounds or more to a door. Also, parameters of the tension device, spring 234, location of slot 220, etc., can also be modified for similar reasons. Thus, for a lighter door, the tension device may apply a force of about 6±1.25 pounds when closed and about 29±2.25 pounds when opened to arm 300 about 4 inches from the hinge center. For a heavy door, the tension device may apply a force of about 8±1.75 pounds when closed and about 46±2.25 pounds when opened. Other choices can be made for intermediate weight doors. In both examples above, the extension of spring 234 is about 5 inches during open.

If desired, two or more different types of springs 234 can be provided to an installer for selection depending on which door style is installed. For example, if a heavier custom door panel is used, a stronger spring can be used providing more force without having to change the damping device 310. Accordingly, if desired an installation kit can be provided including multiple tension devices and or springs 234, so achieve similar soft open performance for various installation choices. Use of such alternate tension devices allows a given damping device to be employed for all units of a given appliance, regardless of potential different door types on a given installation. Also, such can allow for smooth door operation to in view of changes in a door type after installation without changing the damping device; that is, by changing only the tension device a changed door can be accommodated.

In view of the above, various simple and reliable soft open mechanisms are disclosed for a consumer appliance door. Such mechanisms can be used not only within a dishwasher but also within other devices. The various options discussed above with the three different examples can readily be combined in various ways to achieve further examples embodying aspects of the present invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A consumer appliance with a soft open door mechanism comprising:

a cabinet having a top and a bottom and defining an opening along a front side;

a door having a top and a bottom and attached by a hinge to the front side of the cabinet, the hinge at the bottom of the door so that the door is movable between an upright position closing the opening and a substantially horizontal position opening the opening, the upright position and the horizontal position being substantially 90 degrees apart;

an arm mounted to the door and extending outward from the hinge, the arm having an attachment point;

a tension device mounted in the cabinet so as to oppose movement of the door toward the horizontal position; and a damping device having a first end and a second end, the first end of the damping device mounted to the cabinet proximate the top of the cabinet and the front side of the cabinet, the second end of the dampening device mounted to the arm at the attachment point of the arm so as to move with the door, the damping device including damper means activatable by an opening movement of the door toward the horizontal position to provide an opposing force to slow the door motion, the damper means initiating the opposing force only when the door has moved at least 45 degrees from the upright position toward the horizontal position.

2. The consumer appliance of claim 1, wherein the damper means is configured so as to initiate the opposing force only when the door has moved at least 60 degrees from the upright position toward the horizontal position.

3. The consumer appliance of claim 1, wherein the damper means comprises a partial fill damper, the damper being in a substantially vertical position when the door is in the substantially vertical position.

4. The consumer appliance of claim 3, wherein the damper reaches a maximum angle with reference to a vertical line when the door has moved about 45 degrees.

5. The consumer appliance of claim 4, wherein the damper reaches a maximum angle with reference to a vertical line when the door has moved about 38 degrees.

6. The consumer appliance of claim 1, wherein the damper means comprises a partial fill damper, the damper having a fully extended length of about 24 inches.

7. The consumer appliance of claim 6, wherein the damper has a fully compressed length of about 16 inches.

8. The consumer appliance of claim 7, wherein the damper is configured so that, when a 15 pound load is applied axially to the damper in the fully extended length, the damper reaches the fully compressed length in about 10 seconds.

9. The consumer appliance of claim 1, wherein the damper means comprises a partial fill damper, the damper providing the opposing force only within a final 35% of a compression stroke of the damper.

10. The consumer appliance of claim 9, wherein the damper provides the opposing force only within a final 28% of the compression stroke of the damper.

11. The consumer appliance of claim 1, wherein the damper is comprises a partial fill damper, the partial fill damper filled with a mixture that includes 35% oil or less.

12. The consumer appliance of claim 11, wherein the partial fill damper is filled with the mixture that includes 28% oil or less.

13. The consumer appliance of claim 1, wherein the attachment point is located about 6 inches from a center of the hinge.

14. The consumer appliance of claim 1, wherein the arm includes a first portion extending from the hinge and a second portion extending from the first portion and angled with respect to the first portion.

15. The consumer appliance of claim 14, wherein the tension device has one end attached to the first portion of the arm and a second portion attached to the cabinet.

16. The consumer appliance of claim 15, wherein the second end of the damping device is attached to the second portion of the arm.

17. The consumer appliance of claim 15, wherein the tension device includes a tension spring and a line.

18. The consumer appliance of claim 1, wherein the damper means includes a damping coefficient of 200 to 240 lb*s/ft.

19. A consumer appliance with a soft open door mechanism comprising:

a cabinet having a top and a bottom and defining an opening along a front side;

a door having a top and a bottom and attached by a hinge to the front side of the cabinet, the hinge at the bottom of the door so that the door is movable between an upright position closing the opening and a substantially horizontal position opening the opening, the upright position and the horizontal position being substantially 90 degrees apart;

an arm mounted to the door and extending outward from the hinge, the arm having an attachment point;

a tension device mounted in the cabinet so as to oppose movement of the door toward the horizontal position; and a damping device having a first end and a second end, the first end of the damping device mounted to the cabinet proximate the top of the cabinet and the front side of the cabinet, the second end of the dampening device mounted to the arm at the attachment point of the arm so as to move with the door, the damping device including a partial fill damper activatable by an opening movement of the door toward the horizontal position to provide an opposing force to slow the door motion, the damper being configured so as to initiate the opposing force only when the door has moved substantially from the upright position toward the horizontal position, the damper having a damping coefficient of 200 to 240 lb*s/ft.

20. The consumer appliance of claim 19, wherein the damper is configured so as to initiate the opposing force only when the door has moved at least 60 degrees from the upright position toward the horizontal position.

21. The consumer appliance of claim 20, wherein the damper provides the opposing force only during a final 28% of a compression stroke of the damper.

22. The consumer appliance of claim 19, wherein the arm extends about 6 inches from a centerline of the hinge.

23. The consumer appliance of claim 22, wherein the tension device applies a tensioning force to the arm about 4 inches from the centerline of the hinge.

24. The consumer appliance of claim 23, wherein the tension device applies force in a range from 6 to 29 pounds as the door moves from the upright position to the substantially horizontal position via a spring.

25. The consumer appliance of claim 23, wherein the tension device applies force in a range from 8 to 46 pounds as the door moves from the upright position to the substantially horizontal position via a spring.

* * * * *